US011234495B2

(12) United States Patent
Li et al.

(10) Patent No.: US 11,234,495 B2
(45) Date of Patent: Feb. 1, 2022

(54) SLIDER AND ZIPPER

(71) Applicant: ZHEJIANG WEIXING INDUSTRIAL DEVELOPMENT CO., LTD., Zhejiang (CN)

(72) Inventors: Anqing Li, Zhejiang (CN); You Lou, Zhejiang (CN)

(73) Assignee: ZHEJIANG WEIXING INDUSTRIAL DEVELOPMENT CO., LTD., Zhejiang (CN)

( * ) Notice: Subject to any disclaimer, the term of this patent is extended or adjusted under 35 U.S.C. 154(b) by 0 days.

(21) Appl. No.: 16/967,423

(22) PCT Filed: Nov. 1, 2018

(86) PCT No.: PCT/CN2018/113391

§ 371 (c)(1),
(2) Date: Aug. 5, 2020

(87) PCT Pub. No.: WO2019/237640

PCT Pub. Date: Dec. 19, 2019

(65) Prior Publication Data

US 2021/0212419 A1 Jul. 15, 2021

(30) Foreign Application Priority Data

Jun. 15, 2018 (CN) ..... 201810620521.5

(51) Int. Cl.
*A44B 19/30* (2006.01)

(52) U.S. Cl.
CPC ..... *A44B 19/30* (2013.01); *A44B 19/306* (2013.01)

(58) Field of Classification Search
CPC ... A44B 19/30; A44B 19/306; Y10T 24/2586; Y10T 24/2568; Y10T 24/257; Y10T 24/2571
See application file for complete search history.

(56) References Cited

U.S. PATENT DOCUMENTS 8,584,326 B2 * 11/2013 Keyaki ..... A44B 19/306 24/421
9,095,192 B2 * 8/2015 Hamada ..... A44B 19/303
(Continued)

FOREIGN PATENT DOCUMENTS

CN 2909903 Y 6/2007
CN 103124504 A 5/2013
(Continued)

OTHER PUBLICATIONS

International Search Report for PCT/CN2018/113391 dated Feb. 27, 2019, ISA/CN.
(Continued)

*Primary Examiner* — Robert Sandy

(74) *Attorney, Agent, or Firm* — Yue (Robert) Xu; Apex Attorneys at Law, LLP

(57) ABSTRACT

A slider and a zipper comprising the slider. The slider comprises a pull tab, a slider body, and a safety catch; the slider body is provided with an upper base plate and a lower base plate; the upper base plate is provided with a rear rivet body set and a front rivet body set which are arranged in a corresponding manner; when the pull tab is rotated and contacts the front rivet body set, the front rivet body set contacts a side column of the pull tab to block the overturn of the pull tab. The front rivet body set applies a force on the rotated pull tab, such that the pull tab is rebounded to the rear end of the slider with a horizontal part as a rotating axis, and the safety catch is locked downwards to lock the zipper.

8 Claims, 7 Drawing Sheets

(56) References Cited

U.S. PATENT DOCUMENTS

| | | | | |
|---|---|---|---|---|
| 9,271,548 | B2 * | 3/2016 | Keyaki | A44B 19/262 |
| 9,357,816 | B2 * | 6/2016 | Matsushima | A44B 19/30 |
| 2005/0076481 | A1 * | 4/2005 | Lin | A44B 19/306<br>24/421 |
| 2010/0269312 | A1 * | 10/2010 | Wagner | A44B 18/0088<br>24/400 |
| 2013/0160248 | A1 | 6/2013 | Keyaki et al. | |
| 2013/0174387 | A1 | 7/2013 | Hamada | |

FOREIGN PATENT DOCUMENTS

| | | | |
|---|---|---|---|
| CN | 204812418 | U | 12/2015 |
| CN | 106617517 | A | 5/2017 |
| CN | 106923454 | A | 7/2017 |
| CN | 107455858 | A | 12/2017 |
| CN | 107668850 | A | 2/2018 |
| CN | 108652142 | A | 10/2018 |
| DE | 20219817 | U1 | 3/2003 |
| TW | 201416019 | A | 5/2014 |
| WO | 2012032657 | A1 | 3/2012 |
| WO | 2012042620 | A1 | 4/2012 |
| WO | 2012172692 | A1 | 12/2012 |

OTHER PUBLICATIONS

The First Office Action of the priority application 201810620521.5 dated Nov. 5, 2019.
The First Office Action of the Japanese application JP2020-543855 dated Nov. 2, 2021.

* cited by examiner

SLIDER AND ZIPPER

The present application is a national phase application of PCT international patent application PCT/CN2018/113391, filed on Nov. 1, 2018 which claims the priority to Chinese patent application No. 201810620521.5, titled "ZIPPER HEAD AND ZIPPER", filed with the China National Intellectual Property Administration on Jun. 15, 2018, both of which are incorporated herein by reference in their entireties.

This application claims the priority to Chinese patent application No. 201810620521.5, titled "ZIPPER HEAD AND ZIPPER", filed with the China National Intellectual Property Administration on Jun. 15, 2018, which is incorporated herein by reference in its entirety.

FIELD

The present application relates to the technical field of apparel accessories, and in particular to a zipper head and a zipper including the zipper head.

BACKGROUND

Zipper is a kind of auxiliary material used in clothing and is basically composed of a zipper head, cloth strips, zipper teeth, a square bolt, and so on, wherein the zipper head not only affects the opening and closing function of the zipper, but also affects the appearance and convenience of use, therefore, the structural design of the zipper head is crucial. There are many types of common zipper heads, such as ordinary zipper heads, rail-type zipper heads, train-type zipper heads, and spring-type heads.

A spring-rebound-type slider includes a pull body 01, an insurance member, and a pull tab 02. FIG. 1 is a schematic view of a zipper head in the prior art. The spring-head pull tab 02 is in a "locked" state as shown in FIG. 1, that is, the zipper head cannot be easily moved up or down. When the pull tab 02 is in an upright state (that is, the pull body 01 is at a right angle to the pull tab 02, as shown in FIG. 2), the pull tab is in the "unlocked state". FIG. 2 is a schematic view of the unlocked state of the zipper in the prior art, that is, the zipper head can slide smoothly. However, it is common that the zipper head is in the state of FIG. 2 and will not tip over voluntarily after the zipper is closed, which will cause the zipper to loose. Clothes will slide down after the zipper loses the locking force, which brings great inconvenience to sports and bad experience. At present, the improvement of the spring zipper head on the market is only made on the pull tab 02, and the pull tab 02 is improved by providing a return blocker on the pull tab 02. When the pull tab 02 is pulled to be almost perpendicular to the pull body 01, the blocker is in contact with an upper bottom plate of the pull body 01 and the pull tab 02 rebounds back. The disadvantage of this design is that the pull tab 02 gets stuck when the pull tab 02 is right perpendicular to the pull body 01 and does not rebound back.

SUMMARY

In view of this, a first object of the present application is to provide a zipper head to solve the problem that, after the zipper is closed, the zipper head cannot automatically rebound back and the zipper is thereby loosened. A second object of the present application is to provide a zipper including the zipper head.

To achieve the first object, the following technical solutions are provided according to the present application.

A zipper head includes a pull tab, a pull body and an insurance member. The pull body is provided with an upper bottom plate and a lower bottom plate. The upper bottom plate is provided with a rear rivet body group and a front rivet body group which are correspondingly arranged. The rear rivet body group and the front rivet body group form an installation cavity. The pull tab includes a horizontal portion and a side post connected to the horizontal portion. The horizontal portion of the pull tab is provided in the installation cavity and is rotatable along its own axis. The insurance member is connected with the pull body and the pull tab to realize locking. When the pull tab is rotated to a position where the pull tab is in contact with the front rivet body group, the front rivet body group is in contact with the side post of the pull tab to prevent the pull tab from turning over.

Preferably, an inner end surface of the horizontal portion is provided with a first protrusion, and a distance between an upper surface of the first protrusion and the upper bottom plate is larger than a distance between an upper end surface of the front rivet body group inside the installation cavity and the upper bottom plate.

Preferably, a blocker for preventing the pull tab from rotating is provided on one side of the insurance member close to the front rivet body group, and the horizontal portion is provided with a second protrusion cooperating with the blocker.

Preferably, the blocker is arranged along an axial direction of the insurance member.

Preferably, the blocker and the insurance member are integrally arranged.

The zipper head provided by the present application includes the pull tab, the pull body and the insurance member. The pull body is provided with the upper bottom plate and the lower bottom plate. The upper bottom plate is provided with the rear rivet body group and the front rivet body group which are correspondingly arranged. The rear rivet body group and the front rivet body group form the installation cavity. The pull tab includes the horizontal portion and the side post connected to the horizontal portion. The horizontal portion of the pull tab is provided in the installation cavity and is rotatable along its own axis. The insurance member is connected with the pull body and the pull tab to realize locking. When the pull tab is rotated to a position where the pull tab is in contact with the front rivet body group, the front rivet body group is in contact with the side post of the pull tab to prevent the pull tab from turning over.

With the zipper head provided by the present application, when the pull tab is rotated to a position where the pull tab is in contact the front rivet body group after passing by the rear rivet body group, the front rivet body group is in contact with the side post of the pull tab, and the front rivet body group blocks the rotation path of the pull tab by blocking the side post. Moreover, since the front rivet body group exerts force on the rotating pull tab, the pull tab rebounds to the rear end of the zipper head with the horizontal portion as the rotation axis, and the insurance member is locked down to lock the zipper, so that the zipper is fixed at a corresponding position, realizing the rebound of the pull tab.

In order to achieve the second object, a zipper is further provided by the present application. The zipper includes cloth strips, zipper teeth, and a square bolt. The zipper further includes the zipper head according to any one of the above aspects. As the zipper head has the above technical effects, the zipper having the zipper head also has the corresponding technical effects.

BRIEF DESCRIPTION OF THE DRAWINGS

For more clearly illustrating embodiments of the present application or technical solutions in the conventional technology, the drawing referred to for describing the embodiments or the conventional technology will be briefly described hereinafter. Apparently, the drawings in the following description are only some examples of the present application, and for those skilled in the art, other drawings may be obtained based on the provided drawing without any creative efforts.

Figure 1:
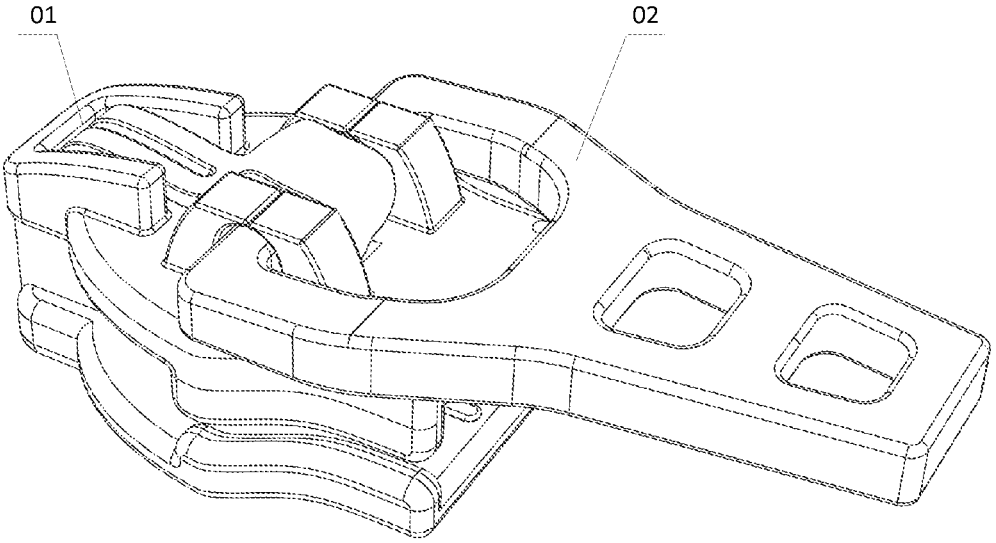
Figure 1 (Prior Art)
FIG. 1 is a schematic structural view of a zipper head in the prior art.
Figure 2:
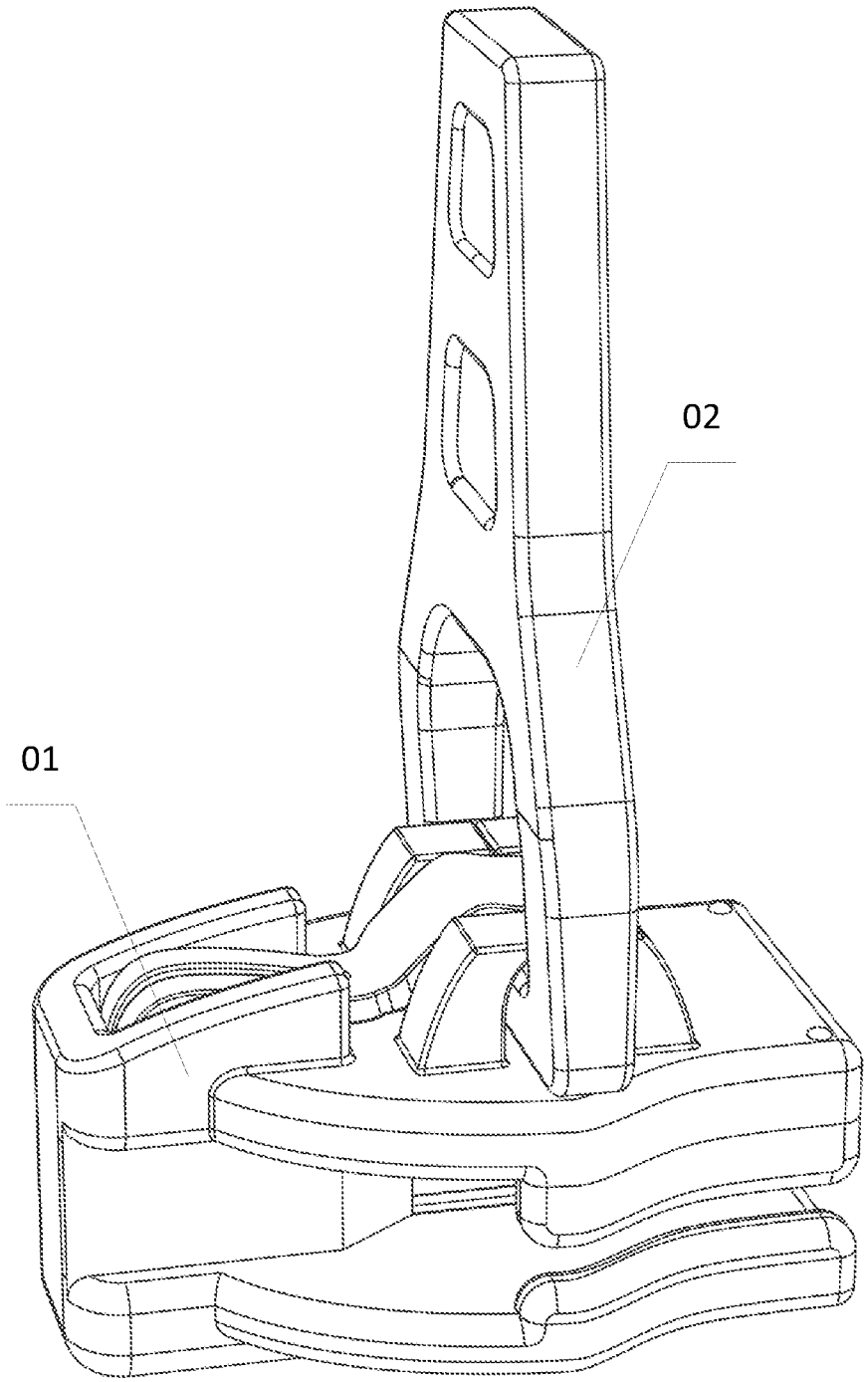
Figure 2 (Prior Art)
FIG. 2 is a schematic view of the unlocked state of the zipper in the prior art.
Figure 3:
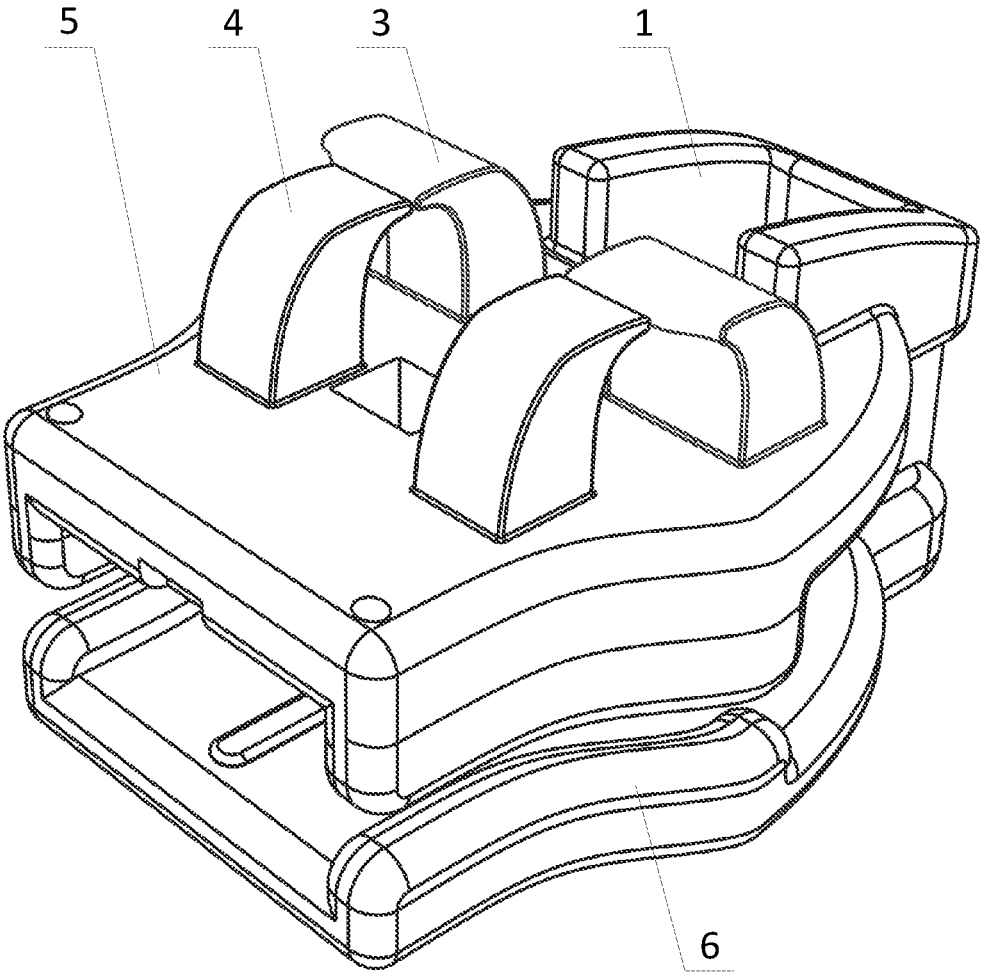
FIG. 3 is a schematic structural view of a zipper head according to an embodiment of the present application.

Reference numerals in FIGS. 1 to 8 are listed as follows:

| | |
|---|---|
| 01 | pull body, |
| 02 | pull tab; |
| 1 | pull body, |
| 2 | pull tab, |
| 3 | front rivet body group, |
| 4 | rear rivet body group, |
| 5 | upper bottom plate, |
| 6 | lower bottom plate, |
| 7 | first protrusion, |
| 8 | second protrusion, |
| 9 | insurance member, |
| 10 | blocker, |
| 20 | cloth strips, |
| 30 | zipper teeth, |
| 40 | square bolt. |

DETAILED DESCRIPTION OF EMBODIMENTS

A zipper head is disclosed according to an embodiment of the present application to solve the problem that, after the zipper is closed, the zipper head cannot automatically rebound back and the zipper is thereby loosened.

Technical solutions of embodiments of the present application will be clearly and completely described hereinafter in conjunction with the drawings of the embodiments according to the present application. Apparently, the embodiments described are only some embodiments of the present application, rather than all embodiments. Any other embodiments obtained by those skilled in the art and based on the embodiments of the present application without any creative work fall in the scope of protection of the present application.

Figure 4:
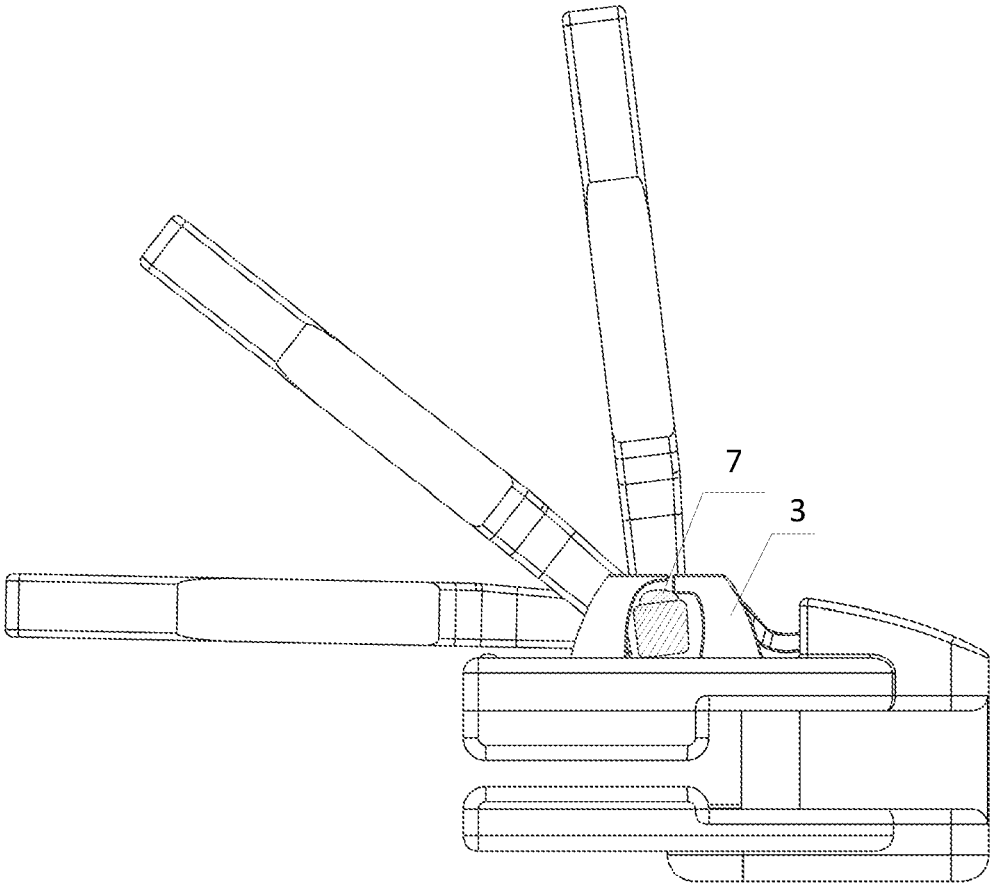
FIG. 4 is a schematic view of a pull-tab rebound structure according to an embodiment of the present application.
Figure 5:
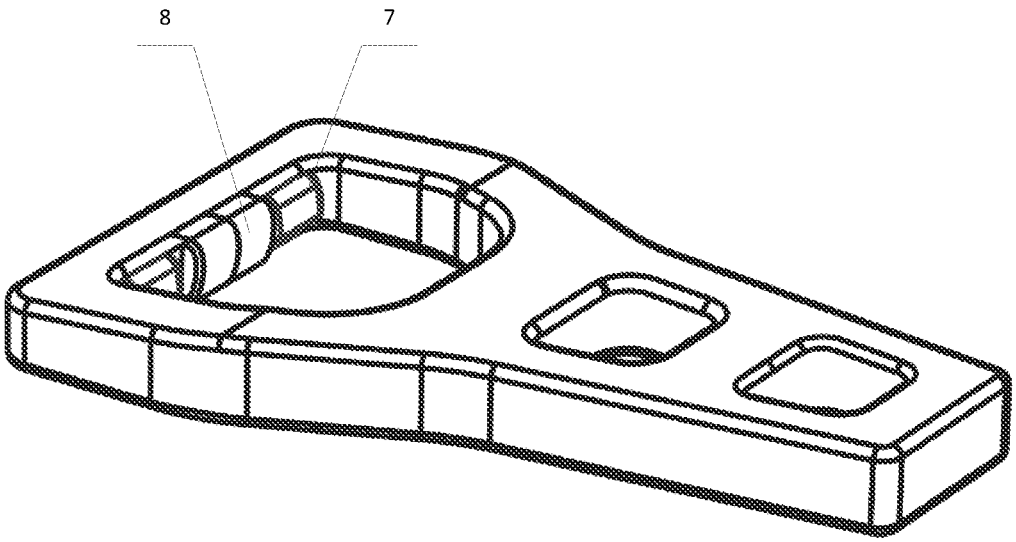
FIG. 5 is a schematic structural view of a pull tab according to an embodiment of the present application.
Figure 6:
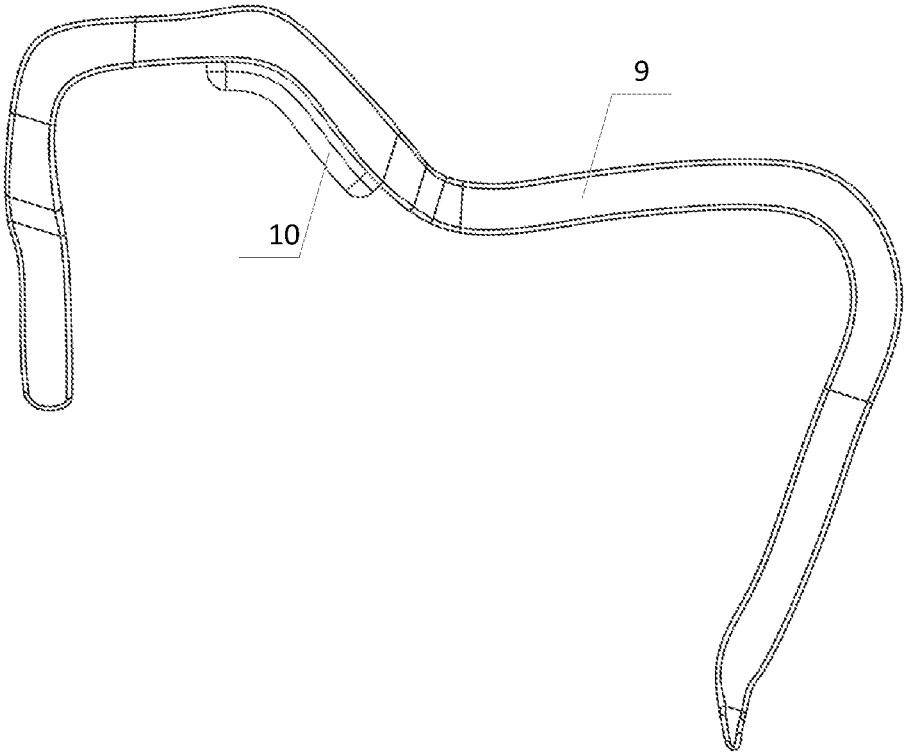
FIG. 6 is a schematic structural view of an insurance member according to an embodiment of the present application.
Figure 7:
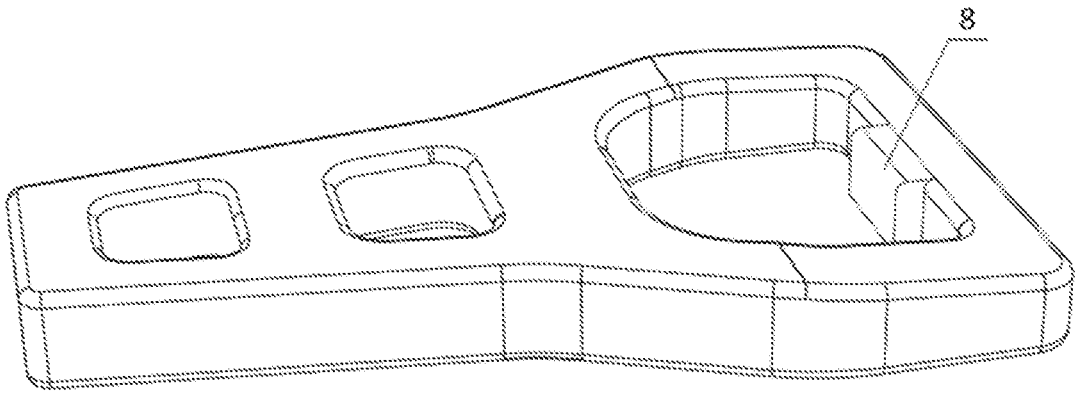
FIG. 7 is a schematic structural view of a second protrusion according to an embodiment of the present application.
Figure 8:
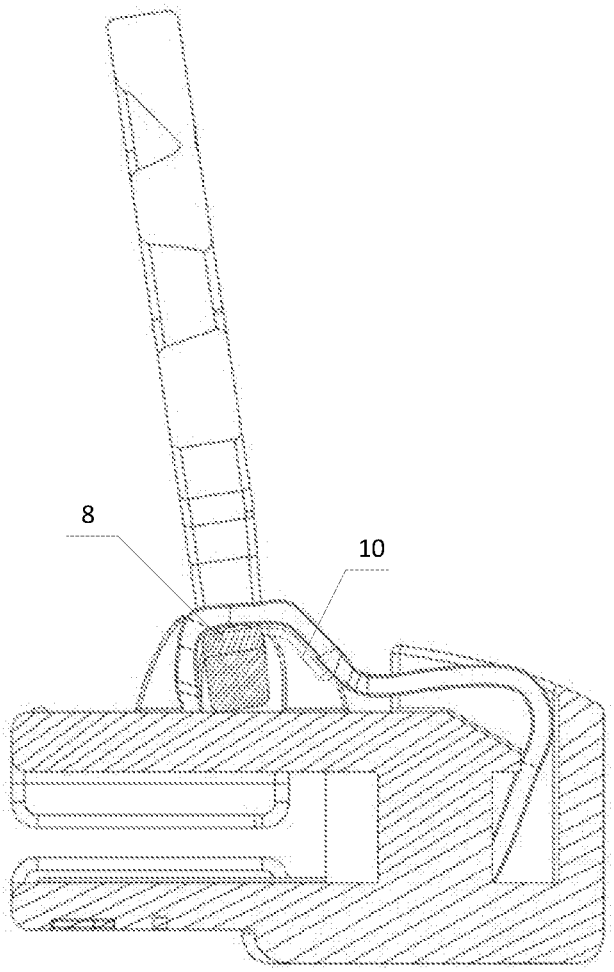
FIG. 8 is a schematic sectional view of the installation of the insurance member according to an embodiment of the present application.
Figure 9:
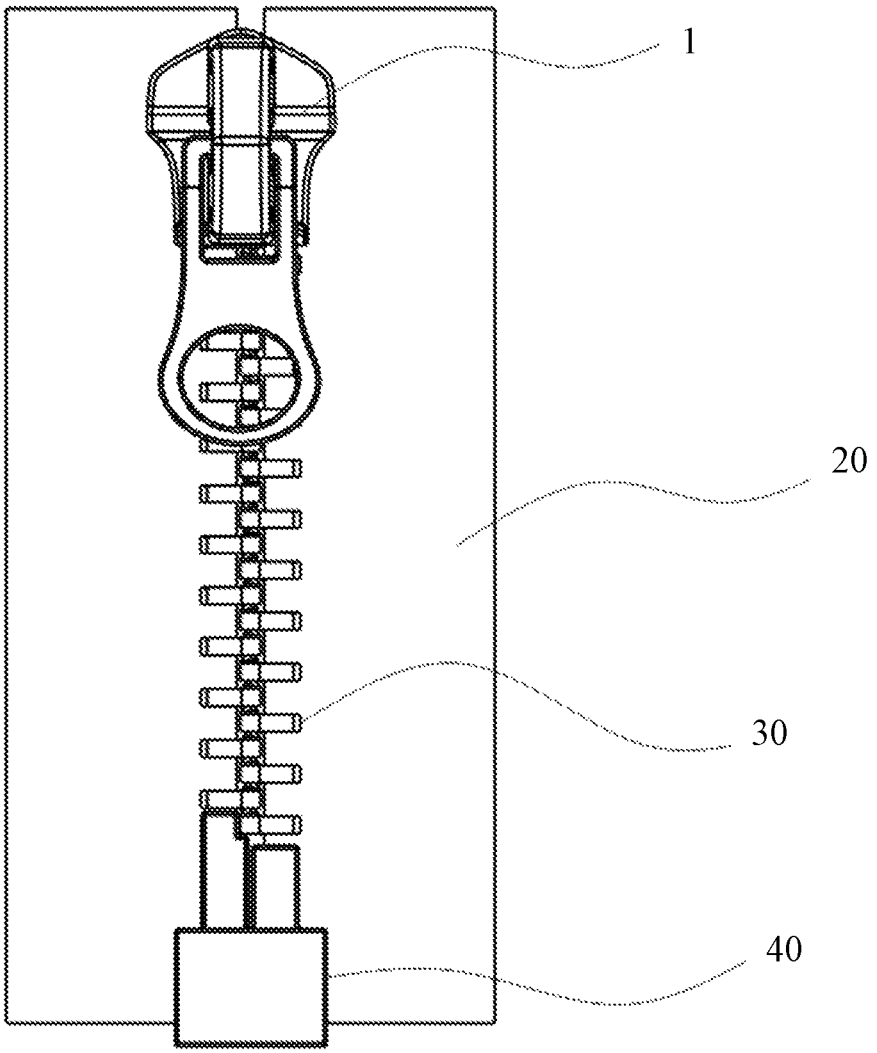
FIG. 9 is a schematic view of a zipper according to an embodiment of the present application.

Referring to FIGS. 3 to 8, FIG. 3 is a schematic structural view of a zipper head according to an embodiment of the present application; FIG. 4 is a schematic view of a pull-tab rebound structure according to an embodiment of the present application; FIG. 5 is a schematic structural view of a pull tab according to an embodiment of the present application; FIG. 6 is a schematic structural view of an insurance member according to an embodiment of the present application; FIG. 7 is a schematic structural view of a second protrusion according to an embodiment of the present application; and FIG. 8 is a schematic sectional view of the installation of the insurance member according to an embodiment of the present application.

In an embodiment, the zipper head provided by the present application includes a pull tab 2, a pull body 1 and an insurance member 9. The pull body 1 is provided with an upper bottom plate 5 and a lower bottom plate 6. The upper bottom plate 5 is provided with a rear rivet body group 4 and a front rivet body group 3 which are correspondingly arranged. The rear rivet body group 4 and the front rivet body group 3 form an installation cavity. The pull tab 2 includes a horizontal portion and a side post connected to the horizontal portion. The horizontal portion of the pull tab 2 is provided in the installation cavity and is rotatable along its own axis. The insurance member 9 is connected with the pull body 1 and the pull tab 2 to realize locking. When the pull tab 2 is rotated to a position where the pull tab 2 is in contact with the front rivet body group 3, the front rivet body group 3 is in contact with the side post of the pull tab 2 to prevent the pull tab 2 from turning over.

The connection manner of the pull body 1 with the upper bottom plate 5 and the lower bottom plate 6 may refer to the prior art. The upper bottom plate 5 is provided with the rear rivet body group 4 and the front rivet body group 3. In general, the rear rivet body group 4 includes two left rivet bodies. Similarly, the front rivet body group 3 includes two right rivet bodies, and the two left rivet bodies and the two right rivet bodies are arranged symmetrically. The rear rivet body group 4 and the front rivet body group 3 form the installation cavity. The pull tab 2 is provided in the installation cavity. The horizontal portion of the pull tab 2 is provided in the installation cavity and is rotatable along the axis of the horizontal portion so as to realize the turning of the pull tab 2. The connection manner of the insurance member 9 with the pull body 1 and the pull tab 2 may refer to the prior art. Specifically, the axial length of the right rivet body along the installation cavity is associated with the position of the side post of the pull tab 2. When the pull tab 2 is rotated to the front rivet body group 3 after passing by the rear rivet body group 4, the side post of the pull tab 2 is in contact with the right rivet body to prevent the pull tab 2 from turning over.

In an embodiment, the zipper head is installed on the clothes, and the pull tab 2 falls on the rear end side of the pull body 1 when not in use. When the pull tab 2 is to be used, the pull tab 2 needs to be lifted to be perpendicular to the pull body 1. When the pull tab 2 is pulled to be almost perpendicular to the upper bottom plate 5 of the pull body 1, the side post of the pull tab 2 is in contact with the front rivet body group 3, so that the pull tab 2 cannot be rotated by an angle larger than 90 degrees, and when the pull tab 2 is rotated by almost 90 degrees, it can topple back to the rear end of the zipper head, which allows the insurance member 9 to be locked down again to lock the zipper.

With the zipper head provided by the present application, when the pull tab 2 is rotated to a position where the pull tab 2 is in contact the front rivet body group 3 after passing by the rear rivet body group 4, the front rivet body group 3 is in contact with the side post of the pull tab 2, and the front rivet body group 3 blocks the rotation path of the pull tab 2 by blocking the side post. Moreover, since the front rivet body group 3 exerts force on the rotating pull tab 2, the pull tab 2 rebounds to the rear end of the zipper head with the horizontal portion as the rotation axis, and the insurance member 9 is locked down to lock the zipper, so that the zipper is fixed at a corresponding position, realizing the rebound of the pull tab 2.

In an embodiment, an inner end surface of the horizontal portion is provided with a first protrusion 7, and a distance between an upper surface of the first protrusion 7 and the upper bottom plate 5 is larger than a distance between an upper end surface of the front rivet body group 3 inside the installation cavity and the upper bottom plate 5. It is conceivable that, the upper surface of the first protrusion 7 cooperates with the upper end surface of the front rivet body group 3 inside the installation cavity, and the distance between the upper surface of the first protrusion 7 and the upper bottom plate 5 is larger than the distance between the upper end surface of the front rivet body group 3 and the upper bottom plate 5. Compared with the rear rivet body group 4, the above purpose can be achieved by increasing the thickness of the upper end surface of the front rivet body group 3 inside the installation cavity. The installation cavity formed by the rear rivet body group 4 and the front rivet body group 3 is preferably a rectangular cavity. Apparently, in other embodiments, the installation cavity may be a circular cavity, which can be configured according to actual needs. All these reasonable configurations are within the protection scope of the present application. It is conceivable that, the distance between the thickened front rivet body group 3 and the upper bottom plate 5 needs to be greater than the thickness of the pull tab 2 to ensure that the pull tab 2 can be implanted. In an embodiment, the first protrusion 7 is provided on two sides of the pull tab 2, and the size and position of the first protrusion 7 correspond to the position of the rivet body on the upper bottom plate 5. When the zipper head is installed on the clothes, after the pull tab 2 is pulled to a certain position, and the pull tab 2 is rotated by almost 90 degrees, the first protrusion 7 is in contact with the upper surface of the front rivet body group 3 inside the installation cavity and cannot be further rotated, the pull tab 2 rebounds back to the rear end of the zipper head, and the insurance member 9 is also locked down to lock the zipper, so that the zipper is fixed at a corresponding position, realizing the rebound of the pull tab 2.

Specifically, a blocker 10 for preventing the pull tab 2 from rotating is provided on one side of the insurance member 9 close to the front rivet body group 3, and the horizontal portion is provided with a second protrusion 8 cooperating with the blocker 10. The blocker 10 may be arranged below the inner side of the insurance member 9 along an axis. When the pull tab 2 is erected to be at a certain angle (not exceeding 90 degrees) to the pull body 1, the blocker 10 is in contact with the second protrusion 8 in the middle of the horizontal portion of the pull tab 2, so that the pull tab 2 is prevented from toppling towards the front end of the pull body 1 and is caused to topple to the rear end of the pull body 1, and the insurance member 9 is locked down to lock the zipper, realizing the fixation of clothes. Preferably, the blocker 10 is arranged along the axial direction of the insurance member 9, and the specific structure of the second protrusion 8 can be arranged according to actual needs, for example, a protruding block. The protruding block may be integrally arranged with the pull tab 2 or fixed by welding and the like, which can be determined according to actual needs. Preferably, the blocker 10 is integrated with the insurance member 9 to facilitate processing.

Based on the zipper head provided in the above embodiments, a zipper is further provided according to the present application, which includes cloth strips, zipper teeth and a square bolt. The zipper further includes the zipper head according to any one of the above embodiments. Since the zipper adopts the zipper head according to the above embodiments, the zipper has similar beneficial effects to the above embodiments.

It should be further illustrated that a relation term such as "first" and "second" herein is only used to distinguish one entity or operation from another entity or operation, and does not necessarily require or imply that there is an actual relation or sequence between these entities or operations. Moreover, the terms "comprise", "include", or any other variants thereof are intended to encompass a non-exclusive inclusion, such that the process, method, article, or device including a series of elements includes not only those elements but also those elements that are not explicitly listed, or the elements that are inherent to such process, method, article, or device. Unless explicitly limited, the statement "including a . . . " does not exclude the case that other similar elements may exist in the process, the method, the article or the device other than enumerated elements.

The above embodiments are described in a progressive manner. Each of the embodiments is mainly focused on describing its differences from other embodiments, and references may be made among these embodiments with respect to the same or similar parts.

The above illustration of the disclosed embodiments can enable those skilled in the art to implement or use the present application. Various modifications to the embodiments are apparent to the person skilled in the art, and the general principle herein can be implemented in other embodiments without departing from the spirit or scope of the present application. Therefore, the present application is not limited to the embodiments described herein, but should be in accordance with the broadest scope consistent with the principle and novel features disclosed herein.

The invention claimed is:

1. A zipper head comprising a pull tab, a pull body and an insurance member, wherein the pull body is provided with an upper bottom plate and a lower bottom plate, the upper bottom plate is provided with a rear rivet body group and a front rivet body group which are correspondingly arranged, the rear rivet body group and the front rivet body group form an installation cavity, the pull tab comprises a horizontal portion and a side post connected to the horizontal portion, the horizontal portion of the pull tab is provided in the installation cavity and is rotatable along an axis of the horizontal portion, and the insurance member is connected with the pull body and the pull tab to realize locking; and when the pull tab is rotated to a position where the pull tab is in contact with the front rivet body group, the front rivet body group is in contact with the side post of the pull tab to prevent the pull tab from turning over, wherein a blocker for preventing the pull tab from rotating is provided on one side of the insurance member close to the front rivet body group, and the horizontal portion is provided with a second protrusion cooperating with the blocker.

2. The zipper head according to claim 1, wherein an inner end surface of the horizontal portion is provided with a first protrusion, and a distance between an upper surface of the first protrusion and the upper bottom plate is larger than a distance between an upper end surface of the front rivet body group inside the installation cavity and the upper bottom plate.

3. The zipper head according to claim 1, wherein the blocker is arranged along an axial direction of the insurance member.

4. The zipper head according to claim 3, wherein the blocker and the insurance member are integrally arranged.

5. A zipper, comprising cloth strips, zipper teeth and a square bolt, wherein the zipper further comprises a zipper head, the zipper head comprises a pull tab, a pull body and an insurance member, the pull body is provided with an upper bottom plate and a lower bottom plate, the upper bottom plate is provided with a rear rivet body group and a front rivet body group which are correspondingly arranged, the rear rivet body group and the front rivet body group form an installation cavity, the pull tab comprises a horizontal portion and a side post connected to the horizontal portion, the horizontal portion of the pull tab is provided in the installation cavity and is rotatable along an axis of the horizontal portion, and the insurance member is connected with the pull body and the pull tab to realize locking; and when the pull tab is rotated to a position where the pull tab is in contact with the front rivet body group, the front rivet body group is in contact with the side post of the pull tab to prevent the pull tab from turning over, wherein a blocker for preventing the pull tab from rotating is provided on one side of the insurance member close to the front rivet body group, and the horizontal portion is provided with a second protrusion cooperating with the blocker.

6. The zipper according to claim 5, wherein an inner end surface of the horizontal portion is provided with a first protrusion, and a distance between an upper surface of the first protrusion and the upper bottom plate is larger than a distance between an upper end surface of the front rivet body group inside the installation cavity and the upper bottom plate.

7. The zipper according to claim 5, wherein the blocker is arranged along an axial direction of the insurance member.

8. The zipper according to claim 7, wherein the blocker and the insurance member are integrally arranged.

* * * * *